US007578005B2

(12) United States Patent
Vereen

(10) Patent No.: US 7,578,005 B2
(45) Date of Patent: Aug. 25, 2009

(54) BREATHABLE, VENTED, FLAME RESISTANT SHIRT

(75) Inventor: William C. Vereen, Thomasville, GA (US)

(73) Assignee: Riverside Manufacturing Company, Moultrie, GA (US)

( * ) Notice: Subject to any disclaimer, the term of this patent is extended or adjusted under 35 U.S.C. 154(b) by 0 days.

(21) Appl. No.: 11/401,617

(22) Filed: Apr. 11, 2006

(65) Prior Publication Data

US 2007/0245443 A1 Oct. 25, 2007

(51) Int. Cl.
*A41D 13/00* (2006.01)

(52) U.S. Cl. ..... 2/69; 2/81; 2/92; 2/97; 2/108

(58) Field of Classification Search ..... 2/69, 2/122, 81, 88, 92, 97, 108, 106, 115
See application file for complete search history.

(56) References Cited

U.S. PATENT DOCUMENTS

| | | | | | |
|---|---|---|---|---|---|
| 2,084,173 | A | * | 6/1937 | Wexler | 2/87 |
| 2,713,168 | A | * | 7/1955 | Bagnato | 2/93 |
| 3,086,215 | A | * | 4/1963 | Di Paola | 2/93 |
| 4,608,715 | A | * | 9/1986 | Miller et al. | 2/1 |
| 5,168,580 | A | * | 12/1992 | Foo | 2/115 |
| 5,685,015 | A | * | 11/1997 | Aldridge | 2/81 |
| 5,704,064 | A | * | 1/1998 | van der Sleesen | 2/69 |
| 5,727,256 | A | * | 3/1998 | Rudman | 2/115 |

* cited by examiner

*Primary Examiner*—Gary L Welch
*Assistant Examiner*—Alissa J Tompkins
(74) *Attorney, Agent, or Firm*—Smith, Gambrell & Russell

(57) ABSTRACT

A flame resistant shirt is described that has a standard front half, but a back half which includes a cape portion with openings to provide ventilation across the wearer's back.

7 Claims, 2 Drawing Sheets

BREATHABLE, VENTED, FLAME RESISTANT SHIRT

FIELD OF THE INVENTION

This invention is directed to a flame resistant shirt having vents to facilitate heat release and air circulation while preserving flame resistant qualities.

BACKGROUND OF THE INVENTION

Utility maintenance workers, such as linemen, are subject to sudden intense thermal arc flashes and are required to wear flame resistant clothing, including flame resistant shirts, in an attempt to protect themselves. Most flame resistant shirts are made of relatively heavy, impermeable fabric and cause retention of body heat. Heat stress and perspiration can increase the risk to the wearer. Previous efforts to address this problem have involved exotic aramid-based lightweight fabrics and standard shirt construction modified with front vents. These fabrics, while lighter weight, offer a lesser degree of protection, exist in limited color selections and degrade more readily to sunlight and ultra-violet rays than comparable grades of more common flame resistant fabrics. As a result, the end product of these approaches resulted in shirts that were less protective, and yet were more costly and had a different appearance than a standard shirt. Front venting also tended to snag as a worker climbed and grappled with his or her work.

The present invention addresses these problems by using readily available, moderately priced fire resistant fabrics and unique construction techniques. The unique construction consists of several main elements, namely a standard front half, but incorporating a side or back caped vent (or both) with ventilation eyelets under the armpits. These unique features achieve greater ventilation while being constructed in a manner and of materials to ensure compliance with applicable standards and regulations (ASTM F1506, NFPA 70E, and the apparel requirements of CFR 1910-269). The front half of the shirt is made using a high-end fabric, but has a standard design and does not have to be specially made, which reduces the total cost of manufacturing. The vent openings are uniquely made and located so that the wearer should not be exposed to radiant heat through the openings in an arc exposure that is within the rated capacity of the shirt.

It is therefore the object of the present invention to provide a flame resistant shirt that uses readily available flame resistant fabrics, has a standard front half, and a vented back half, which provides ventilation without compromising the flame resistant quality.

Other objects and advantages will be apparent from the detailed description which follows.

DISCLOSURE OF THE PRIOR ART

Applicant is aware of U.S. Pat. No. 4,608,715, and the references cited therein

BRIEF SUMMARY OF THE INVENTION

In accordance with the present invention a shirt is provided, which is constructed entirely of flame resistant materials. The front half of the shirt is of a standard design, having no vent openings or other unusual features. The back half has a cape portion that extends down from the shoulder yoke and may be open at the side, bottom or both, except for strategically placed thread tacking, to keep the cape from blousing. Beneath the cape portion is a mesh panel, extending down from the shoulder yoke parallel to the cape portion. Vent openings or eyelets are formed adjacent the sleeve seams. Air can enter through the vent openings or eyelets, and circulate across the wearer's back, dispersing body heat through the mesh panel, to the open side or bottom vents of the cape portion.

DETAILED DESCRIPTION OF THE DRAWINGS

Reference will now be made in detail to the present embodiments of the invention, as illustrated in the accompanying drawings.

Figure 2:
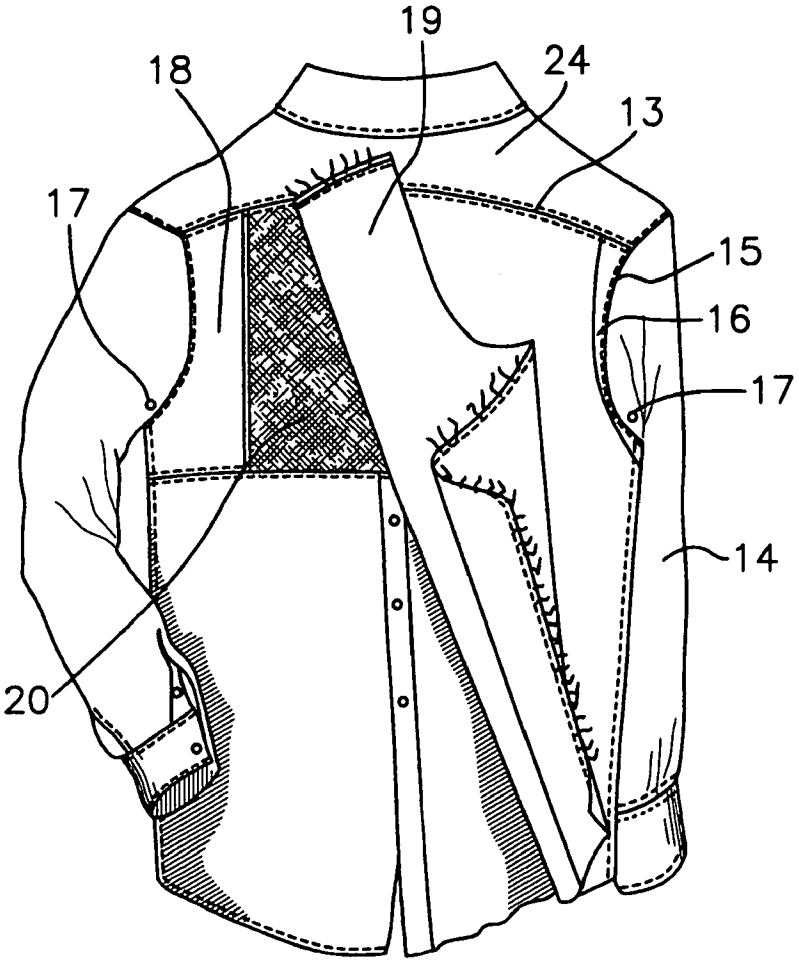
FIG. 2 is a rear perspective view of the shirt, partially disassembled to illustrate its inner layers
Figure 1:
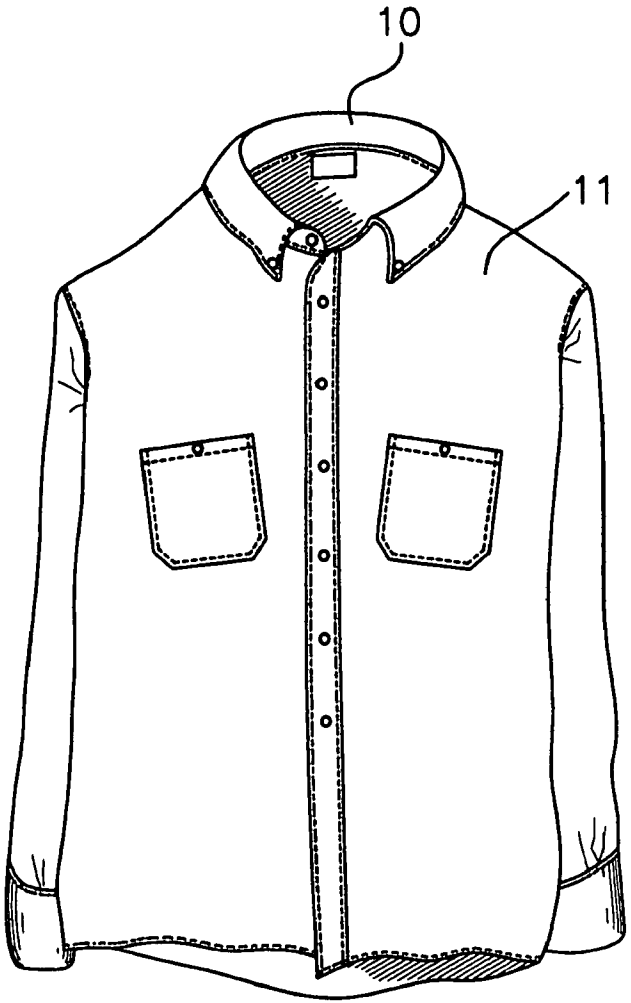
FIG. 1 is a front perspective view of the shirt

FIG. 1 illustrates a shirt 10 made of a flame resistant fabric. Its front half 11 is of a standard shirt front design. The back half of shirt 10 is illustrated in FIG. 2. The cape portion 19 extends down from the shoulder yoke 24, at yoke seam 13. Also extended down from yoke seam 13, is the mesh panel 20 which is covered by the cape portion 19. The mesh panel 20 is made from a flame resistant material and extends between inner panels 18 which are made of the same flame resistant fabric as cape portion 19. The mesh panel 20 is made from a flame resistant material. The inner "safety panels" 18 are attached at sleeve seams 15 to sleeves 14. The panels 18 increase the safety of the vent shirt designs. The mesh panel 20 offers little protection against infrared rays from arc events and must be protected from direct exposure to the UV rays of an arc flash event. The panels 18 move the mesh panel 20 away from the sleeve openings so that there is little chance of them being exposed to infrared rays in an arc flash event. If the panels 18 were not used, the mesh panel 20 would extend to the sleeve seam 15 and would not protect the wearer adequately. The skin or a t-shirt that might be under this shirt 10 could be exposed and that would lead to ignition and burns to the wearer's skin. Vent openings 16 are formed by the gap between the cape portion 19 and the inner panels 18. Eyelets 17 are formed adjacent the sleeve seam 15, using a flame resistant thread such as Nomex. The eyelets 17 provide additional vent openings. Air can circulate from side to side across the back of the wearer.

Figure 4:
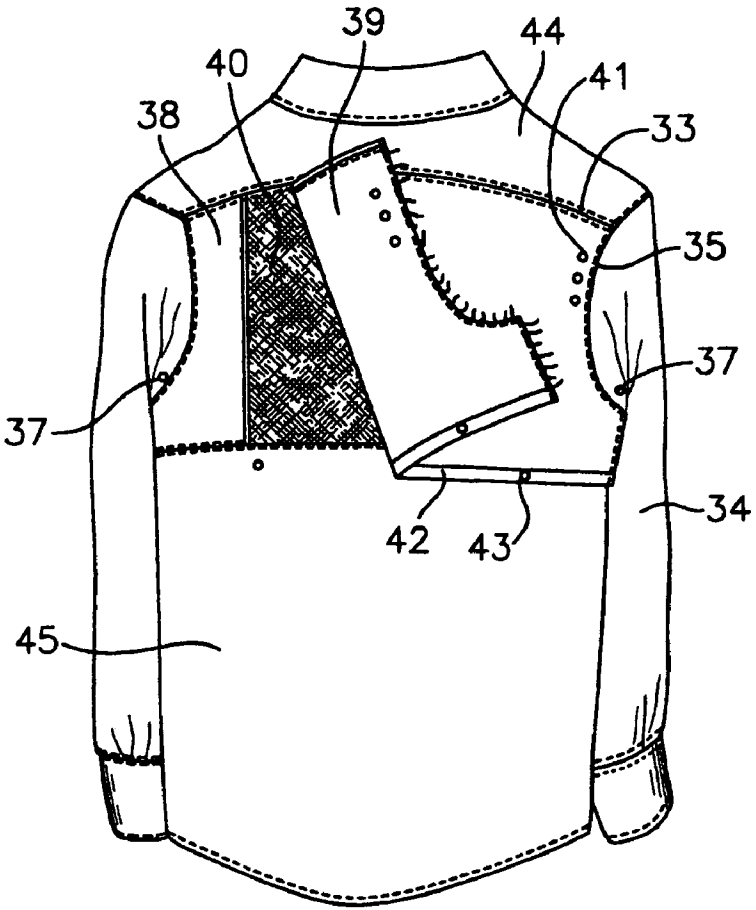
FIG. 4 is a rear perspective view of the shirt of FIG. 3, partially disassembled to illustrate its inner layers
Figure 3:
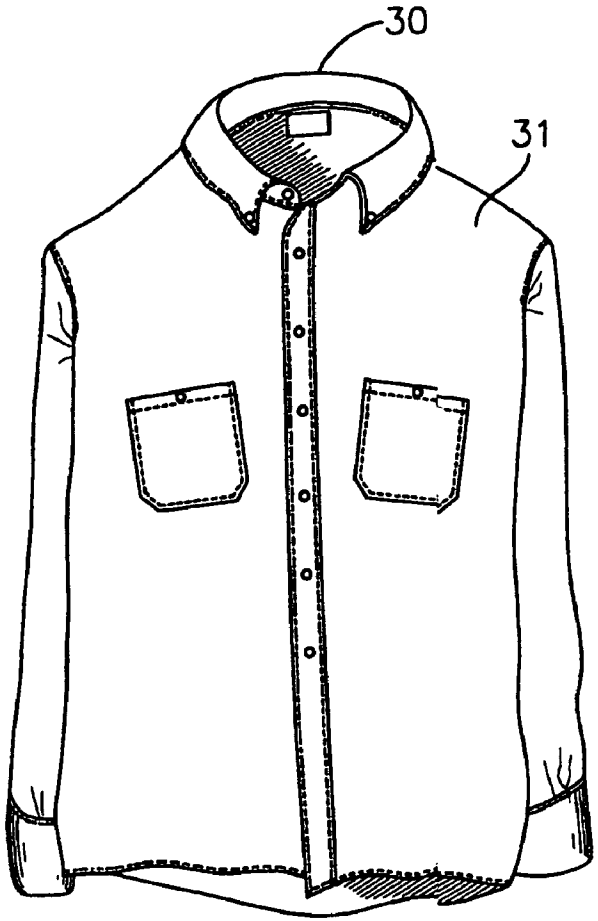
FIG. 3 is a front perspective view of an alternate shirt design

FIG. 3 illustrates an alternative shirt 30 made of a flame resistant fabric. Its front half 31 is of a standard shirt front design. The back half of shirt 30 is illustrated in FIG. 4. The cape portion 39 extends down from the shoulder yoke 44, at the yoke seam 33. Also extending down from yoke seam 33 is the mesh panel 40. The mesh panel 40 extends between inner panels 38 which are made of the same flame resistant fabric as cape portion 39. The mesh panel 40 is made from flame resistant materials. The inner "safety panels" 38 are attached at sleeve seams 35 to sleeves 34. Eyelets 37 are formed adjacent to seams 35, using a flame resistant thread such as Nomex. Additional eyelets 41 are formed on each side of cape portion 39. The bottom panel 45 extends down from mesh panel 40 and its adjacent inner panels 38. The safety offset panels 38 allow ventilation holes in the outer fabric layer that could not exist if the mesh panel 40 was not offset by the safety panels 38. Ventilation eyelets 41 are critical to the proper function of the shirt as they allow heat to escape as it rises into the top of the cape portion 39. These eyelets 41 can increase or become larger to let more air out as long as the safety panels 38 are protecting the mesh from direct infrared exposure. If the eyelets 41 led directly to the mesh (because the offset panels 38 were not employed), it would provide direct access for infrared radiation and could lead to burns or increased ignition hazards from t-shirts. The bottom end of cape portion 39 is open to allow air circulation. However, it has a fold 42, and is tacked at points 43 to keep it from billowing out too much. The tack points 43 are made by a flame resistant thread.

What is claimed is:

1. A shirt constructed of flame resistant material comprising a front half, a back half, and a sleeve on each side of the shirt, the back half including:

a shoulder yoke of flame resistant material extending between said sleeves of flame resistant material, a cape portion of flame resistant material extending downwardly from said shoulder yoke and between said sleeves and having a width, at least one ventilation opening positioned at or near at least one side edge of the cape portion, at least two separate safety panels positioned beneath the cape portion and extending from along at least one edge of the sleeve adjacent the ventilation opening near the edge of the cape portion toward the center of said back half, and an inner mesh panel, fixed to and between said at least two separate safety panels, and extending downwardly from said shoulder yoke, beneath said cape portion, parallel thereto, and having an entire width less than the width of the cape portion, wherein the cape portion and the at least two separate safety panels overlap only at the edges of the cape portion so that the overlapping cape portion and at least two separate safety panels protect the mesh panel from direct infrared exposure through the ventilation opening, and wherein said mesh panel is not completely covered by said at least two separate safety panels.

2. The shirt of claim 1, wherein the said front half is a standard design and has no ventilation openings.

3. The shirt of claim 1, wherein said cape portion is open at the bottom.

4. The shirt of claim 1, wherein said sleeves have ventilation openings at or near their juncture with said cape portion.

5. The shirt of claim 3, wherein said back half includes a lower panel that extends downwardly from said mesh panel, wherein the cape portion overlaps the lower panel, and wherein said cape portion's open bottom is partially constrained by one or more tacks to the adjacent lower panel.

6. A shirt constructed of flame resistant material comprising a front half, a back half, and a sleeve on each side of the shirt, the back half comprising a top half with a neck opening and a bottom half, said back half further including:

a shoulder yoke of flame resistant material extending between said sleeves of flame resistant material, a cape portion of flame resistant material extending downwardly from said shoulder yoke and between said sleeves and having a width, at least one ventilation opening positioned at or near at least one side edge of the cape portion, at least two separate safety panels within only said top half positioned beneath the cape portion and extending from along at least one edge of the sleeve adjacent the ventilation opening near the edge of the cape portion toward the center of said back half, and an inner mesh panel, fixed to and between said at least two separate safety panels, and extending downwardly from said shoulder yoke, beneath said cape portion, parallel thereto, and having an entire width less than the width of the cape portion, wherein the cape portion and the at least two separate safety panels overlap only at the edges of the cape portion so that the overlapping cape portion and the at least two separate safety panels protect the mesh panel from direct infrared exposure through the ventilation opening, and wherein said mesh panel is not completely covered by said at least two separate safety panels.

7. A shirt constructed of flame resistant material comprising a front half, a back half, and a sleeve on the right and left side of the shirt, the back half further including:

a shoulder yoke of flame resistant material extending between said sleeves of flame resistant material, a neck opening within said shoulder yoke with a seam having a left edge and a right edge, a cape portion of flame resistant material extending downwardly from said shoulder yoke and between said sleeves and having a width, at least one ventilation opening positioned at or near at least one side edge of the cape portion, an inner mesh panel, fixed to and extending downwardly from said shoulder yoke, beneath said cape portion, parallel thereto, and having an entire width less than the width of the cape portion, and two separate safety panels positioned beneath the cape portion, said first separate safety panel extending from the edge of the left sleeve and adjacent the ventilation opening near the edge of the cape portion toward the center of said back half and terminating at approximately the left edge of said neck opening seam, and said second separate safety panel extending from the edge of the right sleeve and adjacent the ventilation opening near the edge of the cape portion toward the center of said back half and terminating at approximately the right edge of the neck opening, wherein the cape portion and the at least two separate safety panels overlap only at the edges of the cape portion so that the overlapping cape portion and the at least two separate safety panels protect the mesh panel from direct infrared exposure through the ventilation opening, and wherein said mesh panel is not completely covered by said at least two separate safety panels.

* * * * *